United States Patent [19]

Hamilton

[11] Patent Number: 4,976,201

[45] Date of Patent: Dec. 11, 1990

[54] NON-LETHAL DISTRACTION DEVICE

[75] Inventor: James E. Hamilton, Tallahasse, Fla.

[73] Assignee: Martin Electronics, Inc., Perry, Fla.

[21] Appl. No.: 429,940

[22] Filed: Nov. 1, 1989

[51] Int. Cl.[5] ..... F42B 3/00

[52] U.S. Cl. ..... 102/323; 102/331; 102/336; 102/355; 102/361; 102/275.3

[58] Field of Search ..... 102/323, 331, 336, 355, 102/361, 275.3

[56] References Cited

U.S. PATENT DOCUMENTS

| | | | |
|---|---|---|---|
| 4,324,183 | 4/1982 | Prahauser et al. | 102/334 |
| 4,436,034 | 3/1984 | Jacobsen et al. | 102/334 |
| 4,439,155 | 3/1984 | Roe | 102/334 X |
| 4,452,039 | 6/1984 | Hodgkins et al. | 102/336 |
| 4,462,679 | 8/1984 | Billard | 102/336 X |
| 4,495,868 | 1/1985 | Matthews | 102/361 X |
| 4,681,544 | 7/1987 | Koroscil et al. | 102/336 |
| 4,697,518 | 10/1987 | Lau et al. | 102/361 X |
| 4,718,345 | 1/1988 | Yanan | 102/275.3 |
| 4,730,560 | 3/1988 | Bartholomew et al. | 102/275.3 |
| 4,739,708 | 4/1988 | Halpin et al. | 102/336 |

*Primary Examiner*—Peter A. Nelson

*Attorney, Agent, or Firm*—Finnegan, Henderson, Farabow, Garrett & Dunner

[57] ABSTRACT

A distraction device is comprised of a hollow container that is divided into a first chamber and a second chamber. An explosive charge capable of producing a loud sound and a brilliant flash of light fills the second chamber. A standard M201 hand grenade fuse is installed in the distraction device so that the fuse is in communication with the first chamber. The fuse initiates the sequential ignition of several combustible compositions in the distraction device. A first combustible composition generates a combustion gas of sufficient pressure in the first chamber to separate the expended fuse from the distraction device before the device explodes. The first composition also ignites a combustible time-delay composition, which in turn ignites a spark-producing composition that detonates an explosive output charge. Separation of the fuse from the distraction device before the explosive charge is detonated prevents the fuse from becoming a lethal projectile. The distraction device is useful in law enforcement and military encounters for distracting and temporarily disorienting a suspect or enemy.

13 Claims, 3 Drawing Sheets

NON-LETHAL DISTRACTION DEVICE

BACKGROUND OF THE INVENTION

This invention relates to a distraction device especially adapted for use in law enforcement and military encounters in which bodily injury must be minimized. More particularly, this invention relates to a non-lethal distraction device which produces a blast and a brilliant flash of light which temporarily disorient a suspect or enemy personnel.

Hand grenades are effective offensive weapons because of their low cost, small size, and ease of operation. The standard hand grenade is made of metal and has a flask that is designed to shatter, thus producing a large number of projectiles traveling at high speed. Its purpose is to inflict maximum bodily injury. In many law enforcement and certain military encounters, it is desirable to distract or disorient opposing personnel for a period of time sufficient to enable a law enforcement or military team to mount an offensive maneuver with a minimum risk of bodily injury to all of the personnel involved. The very qualities that make a standard hand grenade effective in battle are the very ones that render the grenade unsuitable for non-lethal use.

It has been found that grenades of non-lethal distraction devices can be made by packing a cardboard container with a combustible charge that will produce an explosion and a brilliant flash of light upon detonation. The resulting audio and visual effects are of such great magnitude that personnel in proximity of the blast are stunned and temporarily disoriented. Temporary immobilization of such personnel in the target area give an attacking force an offensive advantage. Devices of this type are generally referred to as distraction devices.

A non-lethal distraction device can be fabricated from many of the same materials and parts that are used in conventional incendiary grenades. These parts include a standard M201 hand grenade fuse having a pin release and a spring-loaded handle mechanism that activate a conventional fuse material. The fuse material is a pyrotechnic material in a casing that typically weighs about 0.1 lb. It has been found that the casing can become a lethal projectile which can cause serious bodily injury when the distraction device explodes. This result is unacceptable, especially in hostage situations in which the goal is to free captive individuals without bodily harm.

Thus, there exists a need in the art for a non-lethal distraction device. The distraction device should produce a blast accompanied by a large audio effect and a brilliant flash of light. If the blast is accompanied by the production of smoke, the resulting smoke pattern should not obscure the target area after the blast. The distraction device should be of low cost, relatively easy to assemble, and capable of being made with a conventional M201 hand grenade fuse mechanism. Most of all, there is a need in the art for a distraction device in which the quantity of lethal projectiles capable of causing bodily injury is eliminated.

SUMMARY OF THE INVENTION

Accordingly, this invention aids in fulfilling these needs in the art by providing a distraction device comprising a container that is substantially hollow inside. Separator means within the container divide the inside of the container into a first chamber and a second chamber. The separator means has a first surface in the first chamber and a second surface in the second chamber. Aperture means are provided in the container for communication between the first chamber and the environment surrounding the container. Rupturable membrane means are provided in the container for closing the aperture The separator means has opening means for communication between the first chamber and the second chamber. A combustible, rapid-burning, gas-producing, first composition is provided in the first chamber over the first surface of the separator means. A combustible, spark-producing, third composition is provided in the second chamber over the second surface of the separator means. A combustible, time-delay, second composition is provided in the opening in the separator. The combustible second composition is capable of being ignited by the first composition and of subsequently igniting the third composition. The second chamber contains an explosive output charge in sufficient amount to produce an audible blast and a brilliant flash of light to distract or disorient a subject proximate to the distraction device. The output charge is ignitable by the spark-producing, third composition. The container is comprised of lightweight material that readily breaks into nonlethal fragments when the distraction device explodes.

This invention also provides the distraction device of the invention with the M201 hand grenade fuse removably installed in the aperture of the container for igniting the combustible, rapid-burning, gas-producing, first composition in the first chamber. The first composition is provided in an effective amount to generate a combustion gas of sufficient pressure in the first chamber to cause separation of the hand grenade fuse from the container before the output charge is ignited.

This invention provides a distraction device in which the grenade fuse is separated from the device body after the fuse is expended and before the device explodes. Separation of the fuse from the distraction device before the output charge is detonated prevents the fuse from becoming a lethal projectile.

BRIEF DESCRIPTION OF THE DRAWINGS

This invention will be more readily understood by reference to the drawings in which.

DETAILED DESCRIPTION OF PREFERRED EMBODIMENT

The distraction device of this invention will now be described in greater detail As used herein, the term "distraction device" refers to a lightweight explosive device that can be manually thrown into a target area and which does not produce lethal fragments when detonated, but which will produce a brilliant flash of light and an audible sound of high intensity sufficient to distract or at least temporarily disorient a suspect within about 10 feet of the site of detonation.

The distraction device of the invention is non-lethal. By this it is meant that, when the distraction device explodes, the explosion does not result in the formation of fragments or parts from the device that travel as projectiles capable of causing bodily injury to subjects within about 1 foot of the site of detonation.

Figure 1:
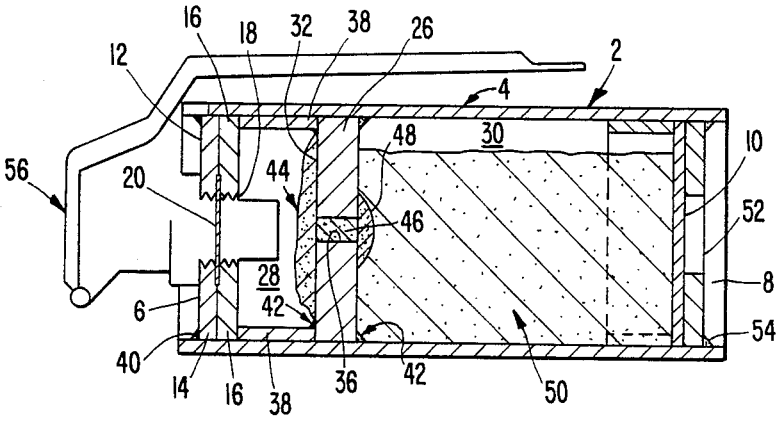
FIG. 1 is a cross-sectional view of one embodiment of the distraction device of the invention with a hand grenade fuse installed in the device.

One embodiment of a distraction device of the invention is depicted in FIG. 1. Referring to this Figure, a distraction device 2 comprises a container 4 that is substantially hollow inside. The container has a front opening 6 and an opposing rear opening 8. A rear wall 10 encloses the rear opening 8 of the container 4.

Front wall means 12 encloses the front opening 6 of the container 4. The front wall 12 is comprised of two disks, 14 and 16, which are superimposed upon each other. An aperture 18 in the front wall 12 provides communication between the inside of the container 4 and the environment surrounding the container. The aperture 18 is adapted to receive a conventional M201 hand grenade fuse 56, which will be described in more detail hereinafter. A rupturable membrane 20 (see FIG. 3) is provided between disk 14 and disk 16 for closing the aperture 18 in the front wall 12 until the fuse is installed in the device.

The container 4 includes separator means 26 which divide the container into a first chamber 28 proximate the front wall 12 of the distraction device and an integral second chamber 30 proximate the rear wall 10. Separator means 26 has a first surface 32 facing the front wall 12 and a second surface 34 facing the rear wall 10. Opening means 36 are provided in the separator 26 for communication between the first chamber 28 and the second chamber 30.

The front wall 12 and the separator 26 are held inside the container 4 as follows. The front wall 12 and separator 26 are slidably received in the container 4. The separator 26 is spaced from the front wall 12 by means of a spacer 38. The front wall 12 is secured to the inside of container 4 by means of a bead or fillet of sealant 40. The separator 26 is held inside the container 4 by means of beads or fillets of a resin adhesive 42, which can be applied between the separator 26 and the container 2 and the separator 26 and the spacer 38 as shown in FIG. 1. The spacer 38 thus maintains the front wall 12 and separator 26 in correct relation to each other, and the sealant 40 and adhesive 42 cement these components inside the container 4. The compositions 46 and 48 should be free of sealant and adhesive when the assembly is complete.

A combustible, rapid-burning, gas-producing, composition 44, which is known in the art as an A-1A composition is applied over the first surface 32 of the separator 26. A combustible, spark-producing, third composition 48 is an ignition drop, which is applied over the second surface 34 of separator 26. A combustible delay composition 46 is provided in the opening 36 in the separator 26 in contact with the A-1A composition and the ignition drop composition. The combustible second composition 46 functions as a delay composition and is capable of being ignited by the A-1A composition 44 and of subsequently igniting the ignition drop composition 48.

An explosive output charge 50 is provided in the integral second chamber 30 of the container 4. The output charge 50 is an explosive main charge that is included in the device in a sufficient amount to produce an audible blast and a brilliant flash of light to distract or disorient a subject proximate to the distraction device. The output charge 50 is ignitable by the spark-producing, ignition drop composition 48.

The output charge 50 is held inside the container 4 as follows. The output charge 50 is packed into the second chamber 30 of the container 4, and rear wall 10 is slidably received in position in the container. A fuse disk 52, which is similar to disk 14 and disk 16, is placed over the rear wall 10. The disk 52 is then secured to the inside of container 4 by means of a bead or fillet of resin adhesive 54. The structural elements that thus form the second chamber 30 are not rupturable or separable from each other prior to explosion of the device.

Figure 2:
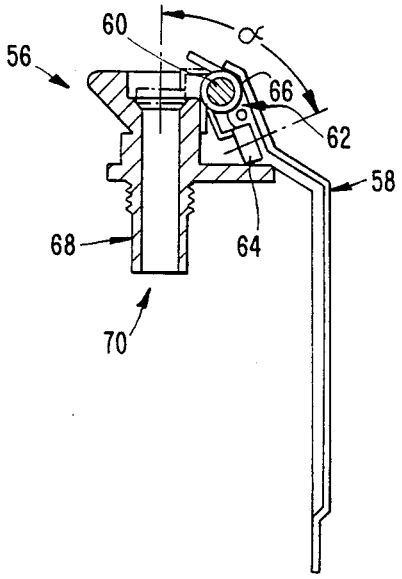
FIG. 2 is a cross-sectional view of a conventional hand grenade fuse suitable for use in the distraction device of the invention.

A standard M201A1 hand grenade fuse will now be described with reference to FIG. 2. A standard M201 hand grenade fuse 56 is comprised of a separable fuse lever 58, which is held in position by means of a retaining pin 60, only a cross-section of which is visible in FIG. 2. The fuse lever 58 holds a pivotable firing arm 62 in a cocked position. The firing arm terminates in a hammer 64. A spring 66 urges the firing arm 62 to rotate in a counterclockwise direction against the retaining force of the fuse lever 58. The hand grenade fuse 56 terminates in an elongated, heavy, hollow fuse body 68. A conventional priming charge and fuse composition (not shown) are provided in the fuse body 68. The fuse body includes an opening 70 for the release of sparks, flame, and combustion products from the priming charge and fuse composition. The standard M201 hand grenade fuse is comprised of metal and typically weights about 70 to about 80 grams.

The standard M201 hand grenade fuse 56 is installed in the container 4 by inserting the fuse body 68 into the aperture 18 (FIG. 1) in front wall means 12 of the stun grenade thereby rupturing the membrane 20. The fuse body 68 engages the disks 14 and 16 to prevent the fuse from separating from the stun grenade 2 prior to ignition of the combustible composition 44. This may be accomplished, for example, by the fuse body 68 frictionally engaging the disks 14 and 16, or by sealing the fuse body in the disks, or as shown in FIG. 1, by threading the fuse body into the disks. In the later embodiment, the fuse body and the disks can be provided with complementary threads or the fuse body can be selftapping. In any event, the fuse must be fitted sufficiently tightly to the container to prevent the fuse from separating from the container before the A-1A composition is ignited.

The distraction device of the invention operates as follows. A standard M201 hand grenade fuse 56 is installed in the distraction device 2 as previously described. The operator grasps both the container 4 of the distraction device 2 and the fuse lever 58 in the hand of his throwing arm. The retaining pin 60 is removed from the fuse 56 with the other hand. Withdrawal of the retaining pin 60 will leave the fuse lever 58, which is held by the thrower's hand, as the only restraining means for the firing arm 62, which is under the force exerted by the spring 66. As soon as the device leaves the hand of the thrower, the spring 66 forces the firing arm 62 and hammer 64 to snap through an arc "$\alpha$" (see FIG. 2) and to detonate the priming charge and fuse composition in the fuse body 70. The fuse lever 58 simultaneously separates from the distraction device.

The opening 70 in the fuse body 68 is positioned proximate the A-1A composition 44 in the first chamber 28. The M201 hand grenade fuse ignites the composition 44, which rapidly burns to produce a combustion gas of sufficient pressure in the first chamber 32 to separate the expended fuse 56 from the distraction device 2. The fuse travels a short distance from the distraction device, typically only about 2 to about 5 feet. The "pop" made upon separation of the fuse 56 from the distraction device 2 is an added feature that tends to further distract a suspect near the detonation site.

In addition to creating a combustion gas of sufficient pressure to separate the expended fuse from the distraction device, the A-1A composition 44 functions as an igniter composition to initiate burning of the delay composition 46 in the opening 36 in the separator 26. The combustible composition 46 functions as a delay and eventually ignites the combustible, spark-producing, ignition drop composition 48. Ignition of the composition 48 detonates the output charge 50 causing the distraction device 2 to explode. Being a single munition, the device detonates at the site of deployment.

The container 4 is comprised of lightweight material that may readily break into non-lethal fragments when the grenade explodes. Prior to the explosion, however, the potentionally lethal fuse 52 has been separated from the device. The resulting audible blast and brilliant flash of light distract or disorient a subject proximate to the site of detonation of the device without the risk of bodily injury caused by the fuse traveling as a projectile. If the output charge should fail to detonate, the integrity of the second chamber 30 is not affected. That is, ignition and burning of the A-1A, delay, and ignition drop compositions do not cause the second chamber to be broken open. The various components that make up the distraction device of the invention will now be described in greater detail.

As previously indicated, the distraction device of the invention is a lightweight explosive device that can be thrown into a target area. While the distraction device of the invention is designed to be manually thrown, it will be understood that the device can be thrown with a mechanical assist, such as a conventional grenade launcher The distraction device can be of any shape, but will usually be shaped to fit comfortably when gripped in the hand of the user. Preferably, the container 4 of the device is in cylindrical form for ease of manufacture and assembly.

The distraction device of the invention is lightweight. Typically, the grenade will weigh about 140 to about 150 grams. Distraction devices within this weight range can be manually delivered to the target area with reasonable effort. Distraction devices of heavier weight, such as about 450 to about 1000 grams, can be employed with mechanical launchers. The weight is generally dependent on the material of construction and the weight of the explosive charge in the second chamber. Thus, distraction devices of high output will generally be heavier than distraction devices of low output.

The distraction device of the invention is comprised of two types of materials, the combustible compositions that burn or explode and the structural components that support or hold the combustible compositions. The structural components, such as the container, the front wall, the rear wall, and the separator, are comprised of lightweight material that is preferably resilient. When the distraction device explodes, the structural materials may break into non-lethal fragments. Visual examination of the fragments shows that the pieces range in size from slivers to pieces about ½ inch square. Being light in weight, the rate of travel of the fragments is quickly reduced by air resistance, and the fragments fall harmlessly to the ground or on subjects in the target area. The resiliency of the material reduces the force of a blow upon impact.

Alternatively, the distraction device may be detonated without resulting in the container breaking into fragments. For example, ignition of the output charge can cause the rear wall 10 to be released from the distraction device without fragmentation of the container 4 by providing a breakable bead of adhesive 54. The container 4 remains substantially intact. In either event, the device of the invention can thus be exploded without cutting and wounding individuals by flying and jagged-edged pieces of heavy material.

Paper and cardboard materials are preferred for use in the structural components, although other materials, such as non-toxic plastics can be employed. It is preferable that the structural components be non-flammable or self-extinguishing in order to avoid a fire when the distraction device explodes. Normally combustible materials, such as paper and cardboard, can be rendered non-flammable by coating or impregnating them with conventional fire retardant materials.

The distraction device of the invention should be fluid-tight and substantially impervious to moisture before the M201 hand grenade fuse is inserted in the aperture of the front wall of the grenade. This will ensure that the combustible compositions are not degraded during storage or prior to use. The structural components can be made of impervious materials or coated or impregnated with compositions that decrease the permeability of the materials. Waterproof sealants and resins can be used for cementing the structural components together.

The membrane 20 closing the aperture 18 in the front wall 12 of the container 4 can be comprised of any material that can be easily ruptured by insertion of the M201 hand grenade fuse into the aperture. An aluminum foil disk is preferred for use as the rupturable membrane 20. The rupturable membrane provides threefold protection. The membrane allows inspection of the hand grenade fuse prior to insertion into the grenade. The rupturable membrane also makes it possible to verify that the distraction device has not been tampered with prior to use. In addition, the M201 hand grenade fuse and the distraction device can be stored and transported separately, thus preventing accidental detonation.

In addition to the structural components, the distraction device of the invention of course requires several combustible compositions. The first combustible composition 44 is A-1A ignition mix that is rapid-burning and capable of producing a combustion gas of substantial pressure in the first chamber 28. The pressure required will mainly depend upon the tightness of the fit between the hand grenade fuse and the front wall of the container. The composition 44 is present in an amount sufficient to generate a combustion gas pressure in the chamber adequate to separate the M201 hand grenade fuse from the distraction device without affecting the integrity of the device and the structural components before the device explodes. Typically, the A-1A composition 44 will be a layer about 0.16 to about 0.23 cm thick weighing about ¾ to about 1 gram. The pressure in the first chamber will typically be about 200 psi to about 210 psi. The combustion gas should of course be non-toxic to prevent injury to personnel in the target area. The gas-producing composition 44 can be applied to the first surface 32 of the separator 26 in the form of a slurry, which can be dried before the separator is installed in the container.

The M201A1 hand grenade fuse 56 is installed in the aperture 18 in front wall 12 so that when the fuse is ignited, the resulting flame and sparks are sufficiently close to the first combustible composition 44 to initiate burning of the composition. Typically, the distance between the opening 70 in the fuse body and the first combustible composition 46 on the first surface 32 of the separator 26 will be approximately 0.6 to about 0.8 cm.

Since the pressure generated in the first chamber 28 following combustion of gas produced by the A-1A composition must be sufficient to cause separation of the fuse from the distraction device, a bearing surface of sufficient size for the gas to act on should be provided to insure this result. The fuse body 68 is of relatively small size and may not provide a sufficient surface area to insure expulsion of the fuse body from the opening 18 in the disks 14 and 16. On the other hand, the front wall 12 provides a bearing surface for the gas that is large relative to the bearing surface provided by the fuse body 68. Thus, in the preferred embodiment of this invention, the assembly comprised of the M201 fuse and the front wall 12 separates from the container 4 after sufficient pressure is generated in the first chamber. Providing a breakable sealant 40 can ensure this result. Alternatively, the front wall can be provided with a weakened area proximate the container 4 to facilitate separation of the assembly comprised of the fuse body 68 and front wall 12 from the distraction device.

The A-1A composition 44 also functions as an igniter for the combustible composition 46 in the opening 36 of the separator. The combustible second composition 46 is a time delay composition, which burns for about 0.2 sec to about 0.4 sec, preferably about 0.3 sec to 0.35 sec. The delay composition is employed in the distraction device in a sufficient amount to achieve this effect and is typically about 0.25 to about 0.35 grams. A combustible second composition, which has been found to provide a suitable time delay, contains the following ingredients:

| Ingredients | Amount |
|---|---|
| Tetra Red Lead Oxide | 80 ± 0.2% |
| Silicon | 16 ± 0.1% |
| Viton A | 4 ± 0.4% |
| Acetone | as required |
| Hexane | as required |

About 0.2 to about 0.3 grams of this composition can be incorporated as a delay composition in the distraction device.

The gas-producing A-1A composition 44 is applied over the combustible delay composition 46 as shown in FIG. 1 to ensure that the delay composition is ignited by the A-1A composition. This adds to the reliability of the distraction device of the invention and reduces the likelihood of failure.

After the lapse of time that accompanies combustion of the delay composition 46, the combustible, spark-producing, ignition drop 48 is ignited by the delay 46. The ignition drop 48 produces sparks and heat sufficient to detonate the output charge 50. A typical ignition drop has the same composition as the time delay composition, except that n-butyl acetate is added in an amount sufficient to form a slurry. It has been found that about 0.4 to about 0.6 gram of this composition is effective as an ignition drop. The ignition drop composition can be applied to the second surface 34 of the separator 26 in the form of a slurry and then dried. The delay composition can contain an additive, such as n-butyl acetate, to improve adhesion to the separator 26. As shown in FIG. 1, it is preferred that the spark-producing ignition drop composition 48 be in contact with the time delay composition 46 to ensure that the composition 48 is ignited.

The explosive output charge 50 is filled into the second chamber 30 in a sufficient amount to produce an audible blast and brilliant flash of light to distract or disorient a subject proximate to the distraction device. The output charge is enclosed in the second chamber under conditions that will result in an explosion when the output charge is ignited, rather than mere burning of tho output charge. The chamber should be sufficiently tight to allow a pressure to build up therein after detonation. The output charge can be comprised of any suitable chemical composition in an effective amount that will burn rapidly and produce an explosion.

The distraction device of the invention produces a very loud repeat. The intensity of the sound must generally be about 168 to about 188 db to function as a distraction device without causing bodily injury. Typically, about 29 to about 31 grams of the output charge will produce a sound of about 170 db to about 174 db within about 5 feet of the detonation site. The magnitude of the audible blast can be varied by adjusting the amount of the explosive output charge in the second chamber or by altering the nature of the compositions in the chamber.

The distraction device of the invention also produces a brilliant flash of light. While the intensity of the light has not been measured, it has been found that the light can have a short-term blinding effect on a subject directly viewing the blast site.

It will be understood that the combustible compositions can produce smoke that may obstruct vision in the blast area. The preferred combustible compositions employed in this invention produce smoke that rapidly rises from the detonation site after the distraction device initiates. Chlorate free explosives aid in achieving this result. This makes it possible for an offensive force to occupy the area with the subjects in full view.

Figure 3:
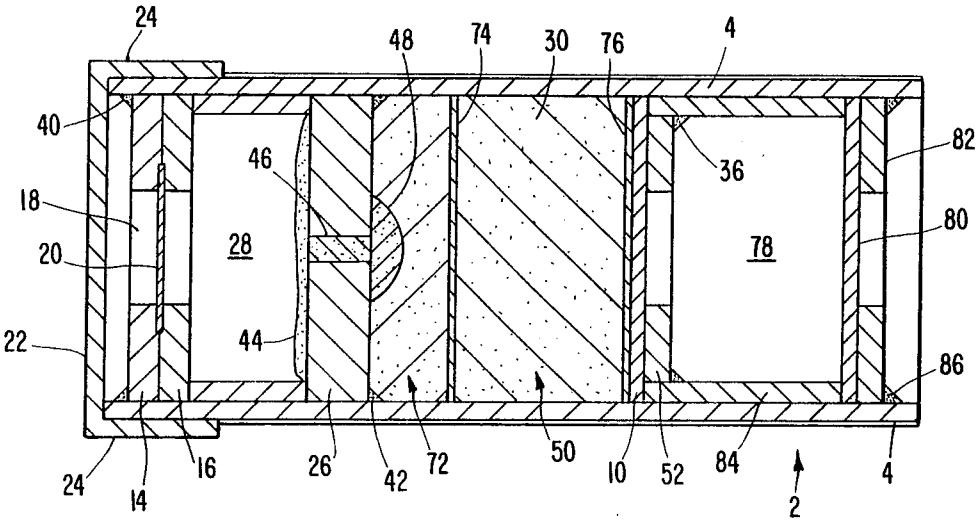
FIG. 3 is another embodiment of a distraction device of the invention, which is capable of producing audio and visual effects of great intensity.

Another embodiment of a distraction device of the invention is shown in FIG. 3. The distraction device 2 in FIG. 3 is similar in many respects to the device 2 in FIG. 1. One difference is in the nature and configuration of the explosive charge in the second chamber 30 of the grenade in FIG. 3. Referring to FIG. 3, the second chamber 30 contains a booster charge 72, which is separated from the explosive output charge 50 by means of a layer of paper 74. The paper layer 74 minimizes migration of the main charge 50 into the booster charge 72, which could adversely affect ignition and the rate of burning of these compositions and thereby lead to failure of the device or a reduction in the audible blast.

The output explosive charge 50 is typically a fluffy, powder material. The material can be packed into the chamber 30 and then covered with another paper layer 76 to hold the explosive charge 50 in position during the device assembly process.

Another optional embodiment of this invention is depicted in FIG. 3. It will be apparent from the Figure that the distraction device 2 includes a longitudinal extension of the container 4 to provide a third chamber 78. The third chamber is formed by providing a wall 80, which is similar in construction to rear wall 10 but which is spaced from wall 10, and a fuse disk 82 similar to fuse disk 52. Fuse disk 52 and wall 80 are maintained in spaced apart relation by means of a spacer 84. These elements are held in position inside the container 4 by means of beads or fillets of adhesive 86.

The addition of the third chamber 78 to the distraction device 2 of the invention is advantageous when it is desired to also use the device as a carrier for a non-toxic irritant. For example, the third chamber 78 can be filled with an irritant, such as tear gas, which will affect respiration or vision of subjects in the target area. When the distraction device initiates, the irritant will be instantaneously dispersed into the atmosphere in the target area and will be inhaled, ingested, or absorbed by subjects in the area. The irritants can thus have a significant effect on the behavior of the subjects, who will also be distracted or disoriented by the audible blast and the flash of light.

The distraction device 2 can optionally include a removable cover, such as the cover 22 shown in FIG. 3. The cover 22 is in the form of a cap having flange means 24 that frictionally engage the container 4 to thereby hold the cap unto the container. The cover 22 prevents accidental rupture of the membrane 20 prior to installation of the hand grenade fuse in the aperture 18.

It will be apparent from the foregoing description that the distraction device of this invention has a number of advantages. The device is especially adapted for use in law enforcement and military situations in which subjects in a target area must be immobilized without causing bodily harm. The device of the invention is especially adapted for use in these situations, because harmful projectiles are not formed when the device initiates. Because the distraction device is constructed with a M201A1 hand grenade fuse, no additional instruction as to its mode of operation is required for law enforcement and military personnel already familiar with the ordinary explosive hand grenade. While the principal function of the distraction device is to produce a deafening sound, the device of the invention is essentially a pyrotechnic device. Thus, it can be employed as signalling means, such as in distress situations. The device can also be used as an illuminating device. The distraction device of the invention can be detonated without cutting or wounding personnel by flying pieces of debris following explosion. The device of the invention is harmless and life-conserving and keeps bodily injury to a minimum following explosion.

What is claimed is:

1. A distraction device comprising:

a container that is substantially hollow inside;

separator means within the container for dividing the inside of the container into a first chamber and a second chamber, wherein the separator means has a first surface in the first chamber and a second surface in the second chamber;

aperture means in the container for communication between the first chamber and environment surrounding the container;

rupturable membrane means for closing the aperture in the container;

opening means in the separator means for communication between the first chamber and the second chamber;

a combustible, rapid-burning, gas-producing, first composition in the first chamber over the first surface of the separator means;

a combustible, spark-producing, third composition in the second chamber over the second surface of the separator means;

a combustible, time delay, second composition in the opening means in the separator, wherein the combustible second composition is in contact with the first composition and the third composition and is capable of being ignited by the first composition and of subsequently igniting the third composition;

an explosive output charge in sufficient amount in the second chamber to produce an audible blast and brilliant flash of light to distract or disorient a subject proximate to the distraction device, wherein the output charge is ignitable by the spark-producing, third composition; and wherein the container is comprised of lightweight material that forms non-lethal fragments if the container breaks when the distraction device initiates.

2. A distraction device comprising:

a container that is substantially hollow inside, wherein the container has a front opening and an opposing rear opening;

a rear wall enclosing the rear opening of the container;

front wall means for enclosing the front opening of the container;

aperture means in the front wall means for communication between the inside of the container and environment surrounding the container;

rupturable membrane means for closing the aperture in the front wall means;

separator means within the container for dividing the inside of the container into a first chamber proximate the front wall means and a second chamber proximate the rear wall, wherein the separator means has a first surface facing the front wall and a second surface facing the rear wall;

opening means in the separator means for communication between the first chamber and the second chamber;

a combustible, rapid-burning, gas-producing, first composition in the first chamber over the first surface of the separator means;

a combustible, spark-producing, third composition in the second chamber over the second surface of the separator means;

a combustible, time delay, second composition in the opening means in the separator, wherein the combustible second composition is in contact with the first composition and the third composition and is capable of being ignited by the first composition and of subsequently igniting the third composition;

an explosive output charge in sufficient amount in the second chamber to produce an audible blast and brilliant flash of light to distract or disorient a subject proximate to the distraction device, wherein the output charge is ignitable by the spark-producing, third composition; and wherein the container is comprised of lightweight cardboard material that readily forms non-lethal fragments if the container breaks when the distraction device initiates.

3. The distraction device as claimed in claim 2, having removable means for covering the membrane means to prevent accidental rupture of the membrane.

4. The distraction device as claimed in claim 3, wherein the means for covering the membrane comprises a removable cap over the front opening of the container, wherein the cap has flanges extending therefrom to frictionally engage the container and thereby hold the cap unto the container.

5. The distraction device as claimed in claim 4, wherein the rupturable means is comprised of aluminum foil.

6. The distraction device as claimed in claim 2, wherein the front wall means is comprised of two superimposed portions secured together with the rupturable membrane between said portions.

7. The distraction device as claimed in claim 2, wherein the first composition is in an amount sufficient to create a combustion gas pressure of about 200 psi to about 210 psi in the first chamber upon combustion of the first composition.

8. The distraction device as claimed in claim 7, wherein the first surface of the separator means is substantially completely covered by the first composition.

9. The distraction device as claimed in claim 7, wherein the combustible, spark-producing, second composition covers the opening in the separator means.

10. A distraction device comprising:

a container that is substantially hollow inside, wherein the container has a front opening and an opposing rear opening;

a rear wall enclosing the rear opening of the container;

front wall means for enclosing the front opening of the container;

separator means within the container for dividing the inside of the container into a first chamber proximate the front wall means and a second chamber proximate the rear wall, wherein the separator means has a first surface facing the front wall and a second surface facing the rear wall;

opening means in the separator means for communication between the first chamber and the second chamber;

aperture means in the front wall means for communication between said first chamber of the container and environment surrounding the container;

a combustible, rapid-burning, gas-producing, first composition in the first chamber over the first surface of the separator means;

a M201 hand grenade fuse in the aperture means in the front wall means for igniting said first composition;

a combustible, spark-producing, third composition in the second chamber over the second surface of the separator means;

a combustible, time delay, second composition in the opening means in the separator, wherein the combustible second composition is in contact with the first composition and the third composition and is capable of being ignited by the first composition and of subsequently igniting the third composition;

an explosive output charge in sufficient amount in the second chamber to produce an audible blast and brilliant flash of light to distract or disorient a subject proximate to the distraction device, wherein the output charge is ignitable by the spark-producing, third composition; and wherein the first composition is provided in an effective amount to generate a combustion gas of sufficient pressure in the first chamber to cause separation of the M201 hand grenade fuse from the container before the output charge is ignited, and further wherein the container is comprised of lightweight material that readily forms non-lethal fragments if the container breaks when the distraction device initiates.

11. The distraction device as claimed in claim 10, wherein the first composition is in an amount sufficient to create a combustion gas pressure of about 200 psi to about 210 psi in the first chamber upon combustion of the first composition.

12. The distraction device as claimed in claim 11, wherein the first surface of the separator means is substantially completely covered by the first composition.

13. The distraction device as claimed in claim 11, wherein the combustible, spark-producing, second composition covers the opening in the separator means.

* * * * *